US005595467A

United States Patent [19]

Jensen

[11] Patent Number: 5,595,467

[45] Date of Patent: Jan. 21, 1997

[54] METHOD AND AN APPARATUS FOR FEEDING A LAUNDRY ARTICLE TO A LAUNDRY PROCESSING APPARATUS

[75] Inventor: Jørn M. Jensen, Bern, Switzerland

[73] Assignee: Ejnar Jensen & Son A/S, Rønne, Denmark

[21] Appl. No.: 380,186

[22] Filed: Jan. 30, 1995

[30] Foreign Application Priority Data

Feb. 8, 1994 [DK] Denmark ..... 0162/94

[51] Int. Cl.[6] ..... D06F 67/04

[52] U.S. Cl. ..... 414/13; 38/143; 271/175; 414/786

[58] Field of Search ..... 38/143; 271/175; 414/13, 786

[56] References Cited

U.S. PATENT DOCUMENTS

| | | | |
|---|---|---|---|
| 2,635,370 | 4/1953 | Mann, Jr. et al. | 38/143 |
| 3,198,315 | 8/1965 | Long, Sr. | 414/13 X |
| 4,671,001 | 6/1987 | Ferrage et al. | 271/175 X |

FOREIGN PATENT DOCUMENTS

| | | |
|---|---|---|
| 0266820 | 5/1988 | European Pat. Off. . |
| 0419382 | 3/1991 | European Pat. Off. . |
| 0424290 | 4/1991 | European Pat. Off. . |
| 0554204 | 8/1993 | European Pat. Off. . |
| 3119574 | 10/1983 | Germany . |

*Primary Examiner*—Karen B. Merritt
*Assistant Examiner*—Janice L. Krizek
*Attorney, Agent, or Firm*—Finnegan, Henderson, Farabow, Garrett & Dunner

[57] ABSTRACT

A method and an apparatus for feeding substantially rectangular laundry articles to a laundry processing apparatus, wherein the laundry article can be positioned in a stretched, hanging and folded state across a bar, which is slidable between two opposed conveyor faces, which pull the laundry article off the bar with a fold so that the laundry article is quickly removed from the bar, thereby making it possible to quickly insert a new laundry article on the bar. A significantly increased productivity with a given number of operators can be achieved through the use of the method and the apparatus of the invention.

11 Claims, 4 Drawing Sheets

METHOD AND AN APPARATUS FOR FEEDING A LAUNDRY ARTICLE TO A LAUNDRY PROCESSING APPARATUS

BACKGROUND OF THE INVENTION

The present invention relates to a a method of feeding substantially rectangular laundry articles to a laundry processing apparatus, such as an ironing roller, comprising spreading of the laundry article, as well as an apparatus for performing the method.

These apparatuses are primarily used in big laundries in which they are used for smoothing and spreading large laundry articles, such as sheets, table-cloths, slips for eiderdowns, etc. for subsequent insertion of the laundry article into e.g. an ironing roller, it being important that these feeding devices spread and smooth the laundry articles effectively so that undesired creases will not occur after the ironing roller. Most frequently, the laundry articles are inserted into the apparatus by a laundry article being taken from a pile of laundry articles in a wrinkled state and optionally wet or damp, following which the laundry article is inserted into the machine, which subsequently processes the laundry article so that it can be transferred to e.g. an ironing roller in a spread and smoothened state.

Numerous proposals for the construction of devices capable of performing the above-mentioned processes are known today. For example, U.S. patent specification 2 635 370 discloses an apparatus for smoothing and spreading large laundry articles, comprising two mutually engaged, narrow conveyor belts between which the laundry article may be inserted and hang down on each side of the lower conveyor belt, following which e.g. air jets may be applied to the surfaces of the article so that the article will flap and be smoothened while hanging in the apparatus. However, the apparatus cannot serve as a feeder, since the large laundry article has then to be manually removed from the apparatus and transferred to optionally an ironing roller. This means that the apparatus cannot at all meet the efficiency requirements made with respect to modern industrial laundries.

EP patent application 424 290 discloses a feeder proper, which comprises i.a. a short and very wide belt conveyor, across which the large laundry article is pulled into position on the belt conveyor from one end thereof, in that approximately the centre of an edge of the laundry article is inserted into grippers adapted for the purpose, said grippers pulling the laundry article into position across the belt conveyor. The laundry article will hereby typically be inclined across the belt conveyor, for which reason means are provided for aligning the laundry article so that two opposed edges on the laundry article are perpendicular to the travelling direction of the belt conveyor. In this situation, the laundry article hangs in a spread and smoothened state across the belt conveyor, there being provided a bar capable of transferring the laundry article from the belt conveyor to an optional, subsequent laundry processing apparatus, such as an ironing roller. However, this requires the laundry article to be positioned correctly before the transfer, which is ensured in that the belt conveyor advances the laundry article a certain distance. Thus, all the above-mentioned processes take place while the laundry article hangs across the belt conveyor, which means that a new laundry article cannot be inserted into the apparatus before the said processes have been completed, and accordingly there is a certain idle time for the operator before a new laundry article can be inserted into the machine.

The object of the invention is to provide a method and an apparatus which significantly reduce the operator's idle time and thereby enables a higher productivity per operator.

SUMMARY OF THE INVENTION

This object is achieved by providing a method of feeding substantially rectangular laundry articles to a laundry processing apparatus, such as an ironing roller, comprising spreading of the laundry article, characterized by positioning the laundry article in a stretched, folded and hanging state across a bar so that the greater part of the laundry article hangs down on one side of the bar and the folded part on the other, following which the laundry article, in the area at the fold, is caused to engage between two opposed conveyor faces which are resiliently engaged with each other and which subsequently pull the laundry article off the bar at said fold.

Also provided is an apparatus for feeding laundry articles to a laundry processing apparatus, such as an ironing roller, characterized by comprising a bar across which the laundry article is positioned in a stretched, folded and hanging state, as well as two opposite conveyor faces resiliently engaged with each other, and comprising means for inserting the bar with the laundry article between the two opposite conveyor faces, said conveyor faces being adapted such that the laundry article is pulled off the bar with its fold foremost and is then moved to an underlying conveyor face.

Since the laundry article is moved away from the bar as soon as it lies on it, the bar is quickly ready to insert a new laundry article. This makes it necessary for the laundry article to be transferred in the machine with a longitudinal crease, which is subsequently smoothened and may optionally be straightened subsequently at another location in the machine.

The invention hereby completely departs from the prejudice that the laundry article necessarily has to be spread completely and be straightened at one and the same location in the machine, which results in the above-mentioned idle times for the operator.

The invention additionally provides a method and an apparatus by means of which final smoothing of the laundry article takes place in a simple manner.

BRIEF DESCRIPTION OF THE DRAWINGS

An expedient embodiment of the invention will be described more fully below with reference to the drawing, in which.

DETAILED DESCRIPTION OF THE INVENTION

Figure 1:
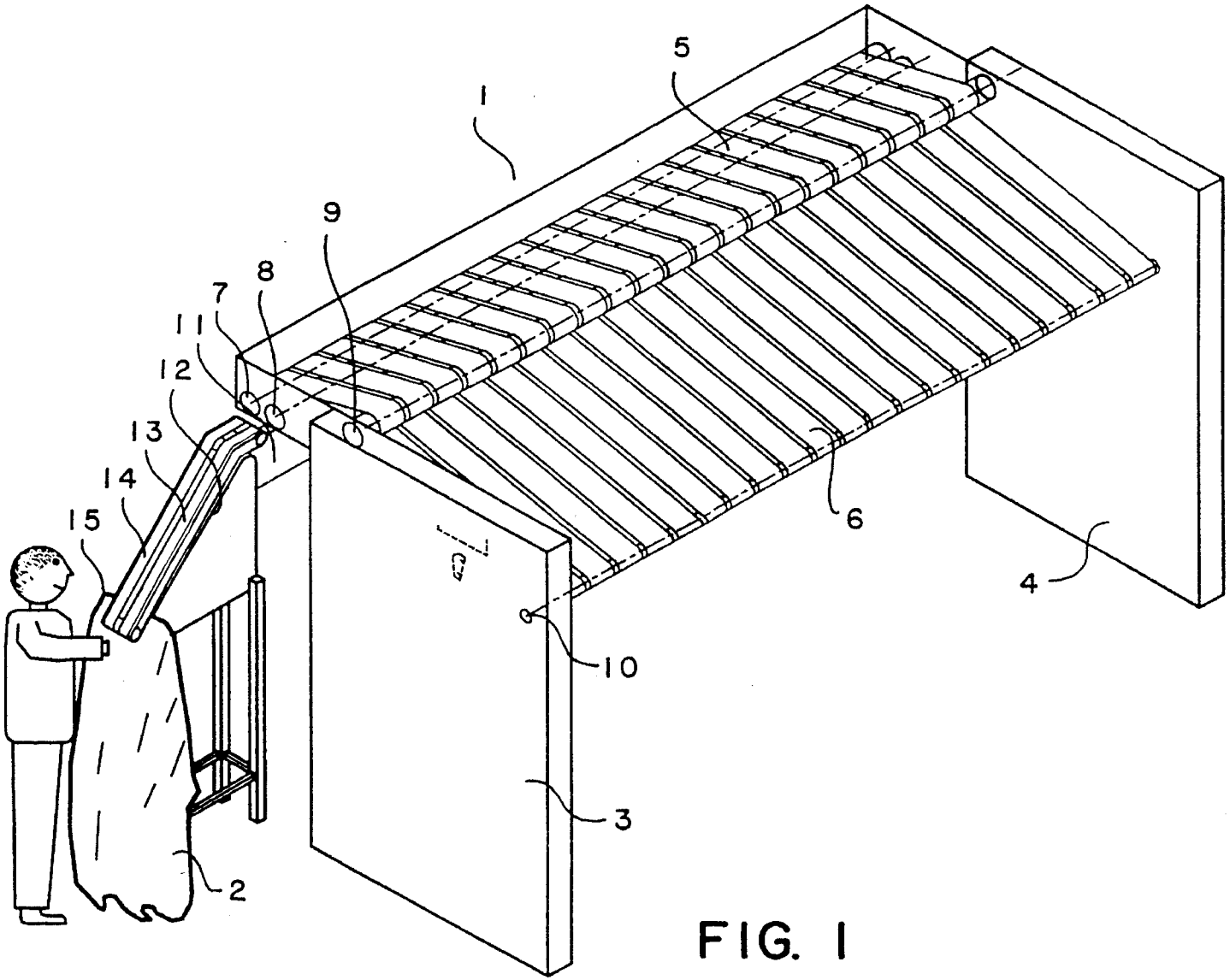
FIG. 1 is a perspective view of an apparatus according to the invention and of an operator.

FIG. 1 is thus a schematic and perspective view of an embodiment of a feeder according to the invention. The machine is provided with two end gables 3 and 4 between which two conveyor belts 5 and 6 are located. The conveyor belt 6 extends partly below the conveyor belt 5, and the conveyor belt 6 is tightened by the rollers 8 and 10.

A bar 11, whose function will be described more fully below, is located below and straight in front of the rollers 7 and 8. An operator-operated insertion device is positioned at one end of the bar 11, as shown; the insertion device here consists of an underlying runway 12, above which two parallel conveyor belts 13 and 14 are positioned so as to be in firm engagement with the runway 12.

The operator starts the process by inserting the laundry article 2 between the conveyor belts 13 and 14 and the underlying runway 12, so that one corner 15 of the laundry article is positioned laterally of the conveyor belts 13 and 14, and so that a small portion of the edge of the laundry article 2 is stretched between the conveyor belts 13 and 14 and the underlying runway 12. The conveyor belts 13 and 14 are then activated to pull the laundry article 2 up to the bar 11.

The function and mode of operation of the feeder 1 will be described now as a series of individual processes according to the method of the invention.

Figure 2A:
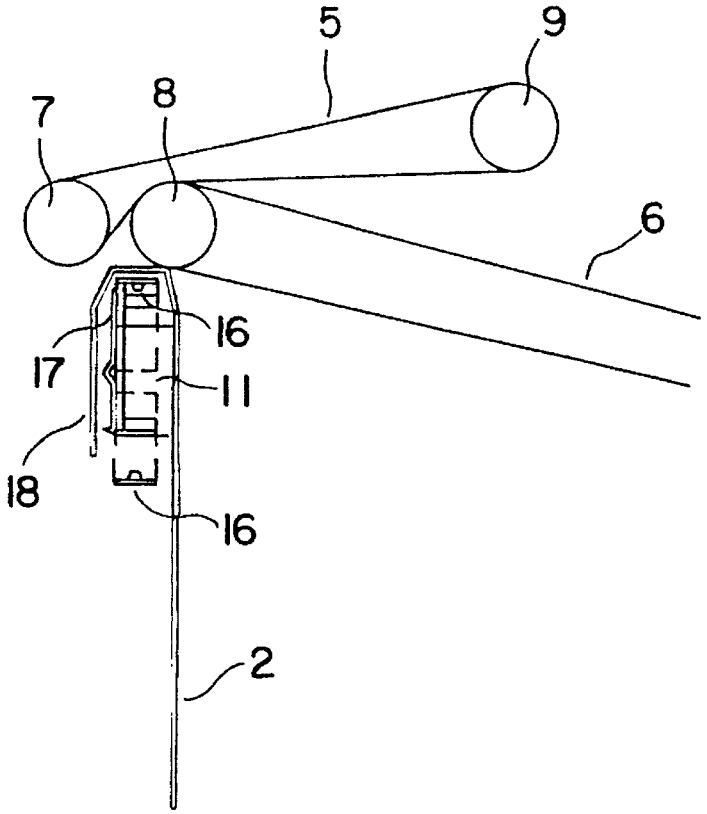
FIG. 2*a* is a schematic sectional view of a detail in the apparatus of FIG. 1.

FIG. 2*a* thus shows that the laundry article 2 is pulled across the bar 11, which is positioned below the rollers 7 and 8 that tighten the conveyor belts 5 and 6. This is done through the provision of a narrow conveyor belt 16 which extends the entire length of the bar, and which can thus pull the entire laundry article 2 into position on the bar 11. When the laundry article 2 is introduced at the end of the bar with one of the corners 15 of the laundry article 2, as stated above, the laundry article 2 hangs across the bar 11 with a minor or folded flap 18 bent across the bar 11.

This increases the efficiency of the apparatus since the operator, when inserting laundry articles into the apparatus does not have to find a central portion on one of the edges of the laundry article or two adjacent corners on the laundry article. Here the operator just has to find a corner on a laundry article and stretch a short portion of an edge adjacent the corner of the laundry article. This makes it simpler for the operator to handle the laundry article, which results in a further improvement in productivity.

Further, since the bar has a narrow conveyor belt having an upper conveyor face extending the entire length of the bar, this makes it possible to insert the laundry article in a simple manner from one end of the bar.

Figure 2B:
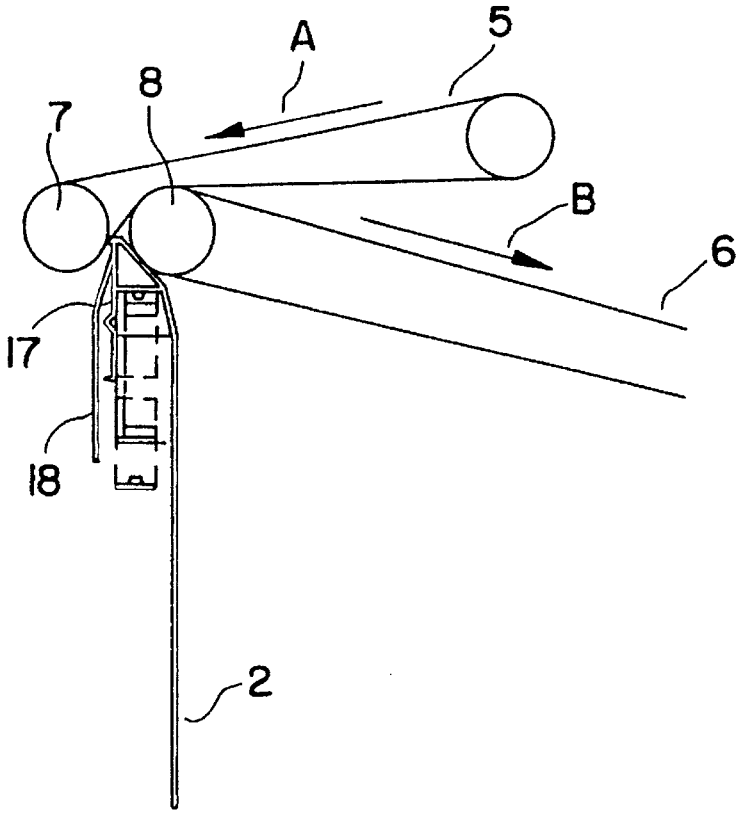
FIG. 2*b* is a view of the detail of FIG. 2*a* in another process position.

The bar 11 additionally comprises a slidable plate element 17 which extends in the entire length of the bar 11. As shown in FIG. 2*b*, the slidable plate element 17 is moved by means (not shown) up toward the rollers 7 and 8 of the conveyor belts 5 and 6, the conveyor belt 5 being caused to move in the direction of the arrow A, and the conveyor belt 6 being correspondingly caused to move in the direction of the arrow B. The movements of the conveyor belts 5 and 6 will cause a laundry article 2 with the bent flap 18 to be pulled up as the slidable plate element 17, is moved up between the rollers 7 and 8.

Thus the slidable plate 17 provides a particularly simple manner of transferring the laundry article to the conveyor 6, wherein the risk of possible wrinkles on the laundry article is reduced significantly.

Figure 3:
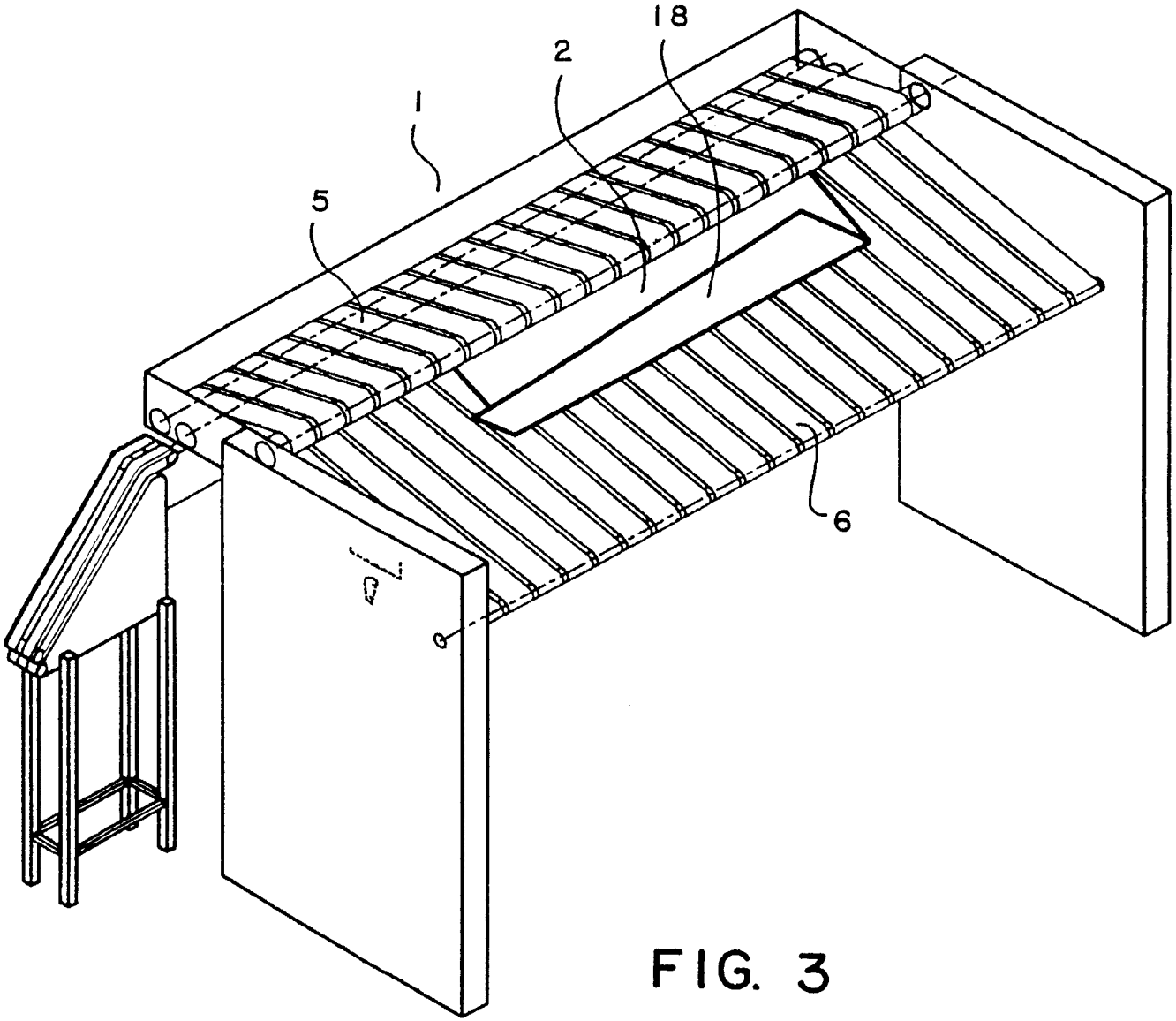
FIG. 3 is a view of the apparatus of FIG. 1 with a laundry article transferred in the machine with a fold.
Figure 4:
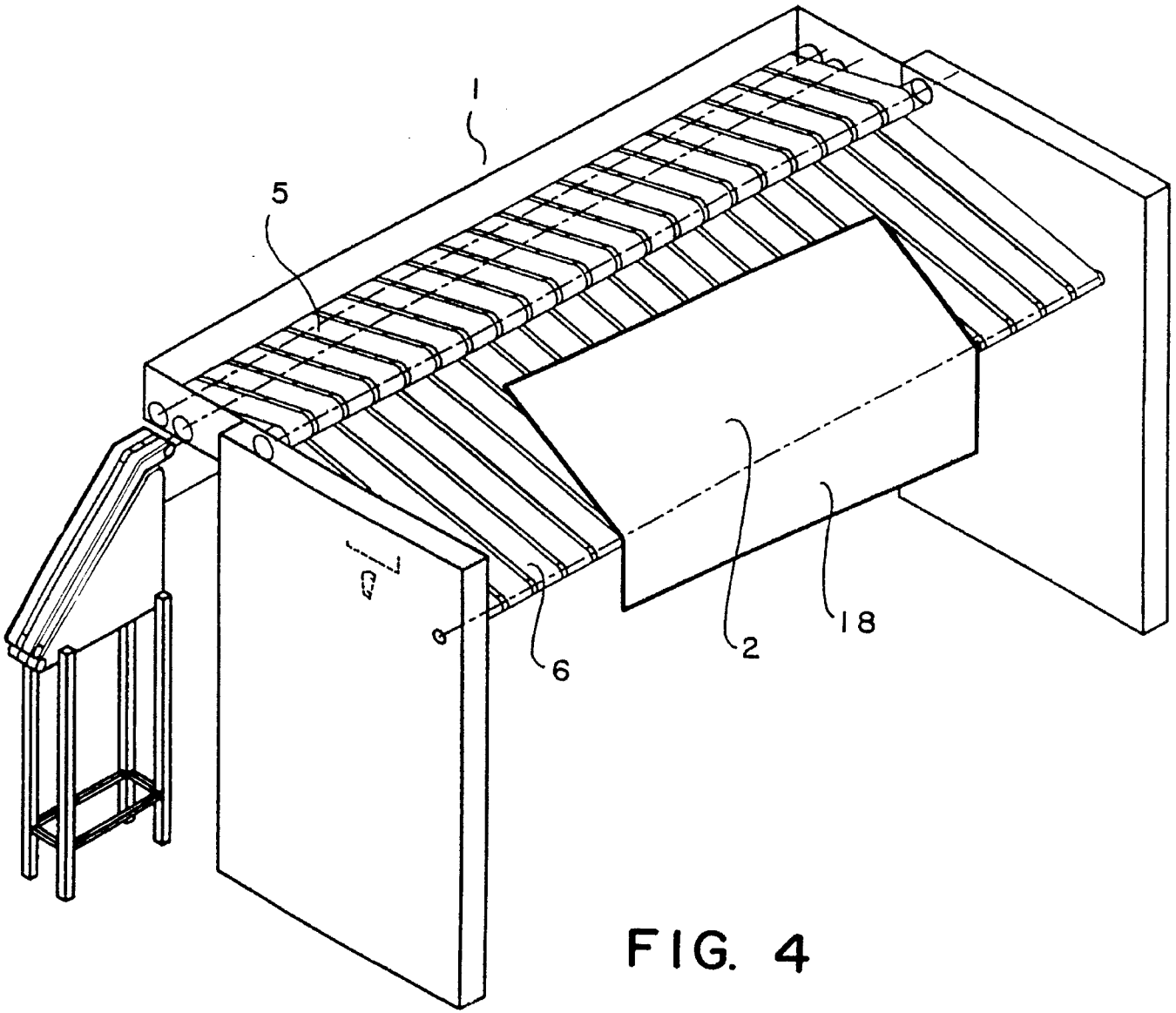
FIG. 4 shows the apparatus of FIG. 3 where the laundry article is smoothened.

The movements of the conveyor belts 5 and 6 will then bring the laundry article 2 with the bent flap 18 into a position in which the laundry article 2 is positioned, as shown in FIG. 3, on top of the conveyor belt 6. Since the laundry article 2 has now been removed from the bar 11, the operator can insert a new laundry article 2 already now and begin the process once more. Final smoothing of the laundry article 2 then takes place, as shown in FIG. 4 in that the continued movement of the conveyor belt 6 in the direction B shown in FIG. 2*b* causes the laundry article 2 to be moved toward the edge of the conveyor belt 6 which is defined by the roller 10, following which the bent flap 18 on the laundry article 2 drops beyond the edge, and the laundry article has hereby been completely straightened and smoothed.

The shown embodiment operates, as shown in the drawings, in such a manner that the flap 18 of the laundry article 2, on the conveyor belt 6, is bent outwardly and in a direction away from the conveyor belt 6. However, the invention will also operate satisfactorily, if the flap 18 of the laundry article 2 is bent inwardly and beneath the laundry article 2 and thus bent in a direction toward the conveyor belt 6.

It is clear that the embodiment described above and shown in the drawings may be varied in numerous ways. Thus, the insertion device may alternatively comprise a pair of grippers which retain the laundry article 2 in fundamentally the same way as is the case with the conveyor belts 13 and 14 and the runway 12. In addition, these grippers may be adapted so as to pull the laundry article 2 all the way across the bar 11, thereby making the conveyor belt 16 of the bar 11 superfluous.

As regards the conveyor faces in this structure, these may moreover alternatively be formed by optional roller paths, air cushion paths and the like, without departing from the idea of the invention.

However, a particularly simple and efficient embodiment is provided by the conveyor faces being opposite conveyor belts which flexibly engage each other. This provides a particularly good and safe control of the laundry article. Moreover, because the conveyor belts constitute the opposite conveyor faces as well as the underlying plane conveyor face, there is provided a particularly inexpensive and simple structure.

It will moreover be obvious to a skilled person to provide sequence control means and drive devices or means, etc. so that the feeder 1 can automatically perform the above-mentioned functions.

However, it should be noted that the embodiment shown in the drawing is unique in being particularly simple and inexpensive in structure, and tests with the feeder 1 have shown that an extremely high productivity is achieved with a single operator. It is even possible, if desired, that the same apparatus may be operated by several operators, there being provided a separate feeder for each operator.

What is claimed is:

1. A method of feeding a substantially flat, rectangular laundry article to a laundry processing apparatus comprising positioning the laundry article in a stretched and hanging state along and over a bar so that a greater portion of the laundry article hangs down on one side of the bar and a minor portion forming a folded part hangs down on the other side of the bar with a fold between said portions, engaging the laundry article in the area at the fold between two opposed conveyor faces that are resiliently engaged with each other and which conveyor faces subsequently pull the laundry article off the bar at said fold.

2. The method of claim 1, including after the laundry article is pulled off the bar, feeding the article on an underlying one of said conveyor faces in a feeding direction with the fold of the article leading toward a terminal edge on the conveyor face far enough so that the fold and the folded part of the laundry article drop over the terminal edge of the conveyor face to thereby spread out the article, the remaining part of the article being retained on the conveyor face.

3. The method of claim 1 or 2, wherein the positioning of the laundry article on the bar comprises stretching a short portion of an edge of the laundry article extending from a corner thereof and inserting the stretched edge into a gripper device at one end of the bar that pulls the laundry article across the bar in the longitudinal direction of the bar.

4. The method of claim 2, wherein the folded part of the laundry article lies on top of the remaining part of the article on the conveyor face.

5. Apparatus for feeding substantially flat, rectangular laundry articles to a laundry processing apparatus comprising a bar, means for positioning a laundry article over and along the bar in a stretched and hanging state so that a greater portion of the article hangs down on one side of the bar and a minor portion forming a folded part hangs down on the other side of the bar with a fold between said portions, two opposed conveyor faces resiliently engaged with each other and located adjacent said bar, insertion means for moving the fold off the bar and inserting the fold of the laundry article between the two opposed conveyor faces, said conveyor faces pulling the laundry article off the bar with its fold foremost and onto the face of an underlying one of said two conveyor faces.

6. The apparatus of claim 5, wherein the underlying conveyor face feeds the laundry article with the fold foremost in a direction toward a terminal edge of the conveyor face far enough so that the fold and the folded part of the laundry article drop over the terminal edge of the conveyor face to thereby spread out the article.

7. The apparatus of claim 5 or 6, wherein the positioning means includes a narrow conveyor belt having an upper conveyor face extending along the entire length of the bar, said narrow conveyor belt being adapted to pull the laundry article from one end of the bar along the bar.

8. The apparatus of claim 7, including a gripper device for feeding the laundry article onto said narrow conveyor belt from one end of the bar, said device comprising holding means adapted to receive and retain a short portion of a stretched edge of the laundry article extending from a corner thereof, said holding means being movable between a first position where the laundry article is inserted into the holding means, and a second position in which the short portion of the stretched edge of the laundry article is over the narrow conveyor belt, said holding means releasing the laundry article at said second position.

9. The apparatus of claim 7, wherein the insertion means comprises a slidable plate element having an edge extending the entire length of the bar and positioned on one side of the conveyor belt and means for moving the edge of the plate element upwardly away from the upper conveyor face of the narrow conveyor belt and between the two opposed conveyor faces.

10. The apparatus of claim 9, wherein the opposed conveyor faces comprise opposed conveyor belts.

11. The apparatus of claim 10, wherein the opposed conveyor belts each include a roller around which the belt extends, said rollers forming a pair of rollers positioned closely to each other and on either side of the bar with a gap between the conveyor belts for receiving the plate element, said conveyor belts extending outwards from said rollers to one side of the plate element with one of the opposed conveyor belts extending substantially above the other opposed conveyor belt, said other opposed conveyor belt forming at least a portion of said underlying conveyor face.

* * * * *